US007992513B2

(12) United States Patent
Shishido

(10) Patent No.: US 7,992,513 B2
(45) Date of Patent: Aug. 9, 2011

(54) DISASSEMBLABLE WHISTLE

(76) Inventor: Hideomi Shishido, Hiroshima (JP)

( * ) Notice: Subject to any disclaimer, the term of this patent is extended or adjusted under 35 U.S.C. 154(b) by 220 days.

(21) Appl. No.: 12/431,351

(22) Filed: Apr. 28, 2009

(65) Prior Publication Data

US 2009/0272311 A1 Nov. 5, 2009

(30) Foreign Application Priority Data

May 1, 2008 (JP) ..... 2008-119973

(51) Int. Cl.
*G10K 5/00* (2006.01)

(52) U.S. Cl. ..... 116/137 R; 446/204

(58) Field of Classification Search ..... 116/137 R; 446/202–208

See application file for complete search history.

(56) References Cited

U.S. PATENT DOCUMENTS 2,113,396 A * 4/1938 Butterfield ..... 446/205
4,277,300 A * 7/1981 Taluba et al. ..... 156/244.14
4,359,961 A * 11/1982 Seron ..... 116/137 R
5,002,006 A * 3/1991 Ehrenreich ..... 116/137 R
5,251,569 A * 10/1993 Seron ..... 116/137 R
7,428,878 B2 * 9/2008 Kim ..... 116/137 R
2006/0272568 A1 * 12/2006 Neidlinger et al. ..... 116/137 R

FOREIGN PATENT DOCUMENTS

CN 201142212 Y * 10/2008
DE 20215018 U1 * 12/2002
JP 9-212171 8/1997
TW 332919 U * 5/2008

* cited by examiner

*Primary Examiner* — R. Alexander Smith
(74) *Attorney, Agent, or Firm* — Gerald E. Hespos; Michael J. Porco

(57) ABSTRACT

A whistle is provided with an interior that can be cleaned. The whistle has a body with a resonance chamber wall. One face of a resonance chamber formed by the resonance chamber wall is open. A side plate is formed separately from the body, and can be attached to and removed from the body. The side plate has a first portion that blocks the one face of the resonance chamber when attached to the body. A first flange is provided on the first portion and is engageable with the resonance chamber wall. At least one of the resonance chamber wall and the first flange is elastically deformable. An air passageway, the resonance chamber, an air opening that is opened in the air passageway, and a sound-emitting opening that is opened in the resonance chamber are formed by the body and the side plate.

14 Claims, 8 Drawing Sheets

DISASSEMBLABLE WHISTLE

BACKGROUND OF THE INVENTION

1. Field of the Invention

This invention relates to a whistle.

2. Description of the Related Art

Whistles are simple tools which are blown by supplying the breath of a human being. Nearly all the portions of a whistle of the prior art are sealed closed. For this reason, it is difficult to clean the interior of a whistle, and hygienic problems result. Saliva adheres to the mouthpiece. Also, saliva remains in the whistle interior. Consequently, the whistle exterior and interior are in a hygienically undesirable state. Specifically, there are the problem of an offensive smell due to bacteria which breeds in the remaining saliva; the problem of elution of whistle material due to the remaining saliva; and the problem of orally transmitted diseases due to pathogenic bacteria. Because of these problems, users have a psychological aversion to using whistles that have been used by other persons.

To address such problems, normally, cleaning with water is performed. However, as shown in FIG. 8, general whistles 502 of the prior art are formed integrally, by bonding members together or similar means. Consequently, the whistle 502 cannot be disassembled. Hence although the exterior of the whistle 502 can be cleaned, water can only be passed through the interior, and adequate cleaning is not possible. For this reason, users cannot avoid a feeling of unpleasantness.

To address this problem, in place of the continuously porous cork ball peas used in the prior art, whistles using plastic ball peas not having minute holes, or using a plastic pipe as a pea, with an antibacterial agent incorporated into the pipe, have been proposed (Japanese Patent Application Laid-open No. H9-212171).

In the whistle of Japanese Patent Application Laid-open No. H9-212171, a pea which does not absorb saliva or other liquids is used. Further, this pea comprises an antibacterial agent. However, only the pea acts to preserve hygiene. Breeding of bacteria from saliva remaining in the air passageway and resonance chamber cannot be suppressed, and so hygiene in the whistle interior cannot be preserved.

SUMMARY OF THE INVENTION

This invention was devised in light of the above problems, and has as an object the provision of a practical whistle a side plate of which can easily be attached and removed, and the interior of which can be cleaned.

In order to attain this object, a whistle of this invention comprises a body, having a resonance chamber wall, with one face of a resonance chamber formed by this resonance chamber wall open, and a side plate which is formed separately from the body, and can be attached to and removed from the body; the side plate has a first portion which blocks the one face of the resonance chamber in the state of being attached to the body, and a first flange which is provided on the first portion and engageable with the resonance chamber wall. At least one of the resonance chamber wall and the first flange is elastically deformable, and an air passageway, the resonance chamber, an air opening which is opened in the air passageway, and a sound-emitting opening which is opened in the resonance chamber, are formed by means of the body and the side plate.

By means of this invention, by elastically deforming the resonance chamber wall or the first flange, the side plate can be attached to and removed from the body by simple means. Consequently, whistle interior, such as the resonance chamber and air passageway, can be more reliably cleaned, breeding of bacteria due to remaining saliva can be suppressed, and hygiene of the whistle can be secured.

DETAILED DESCRIPTION OF THE PREFERRED EMBODIMENTS

Figure 1:
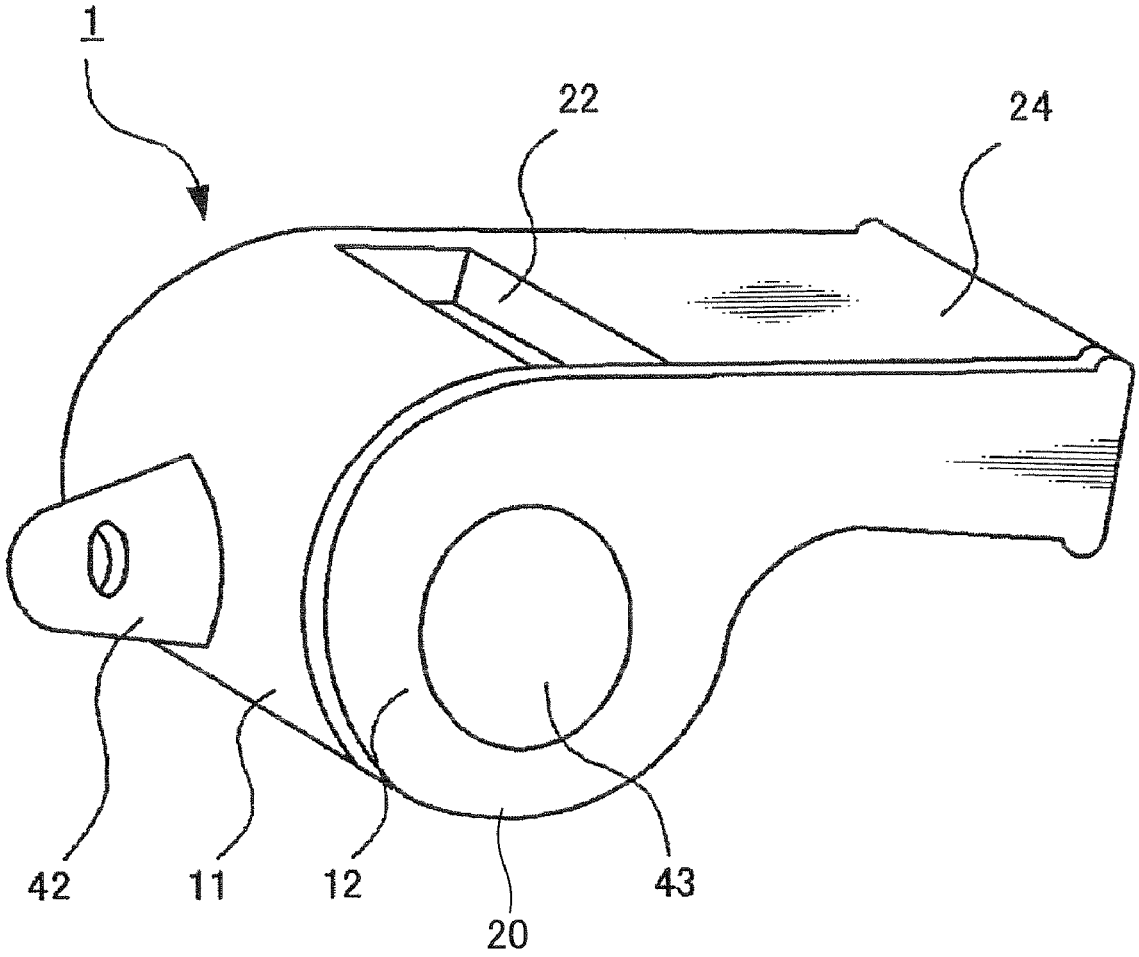
FIG. 1 is a perspective view showing the external appearance of the whistle of an embodiment of the invention.
Figure 2A:
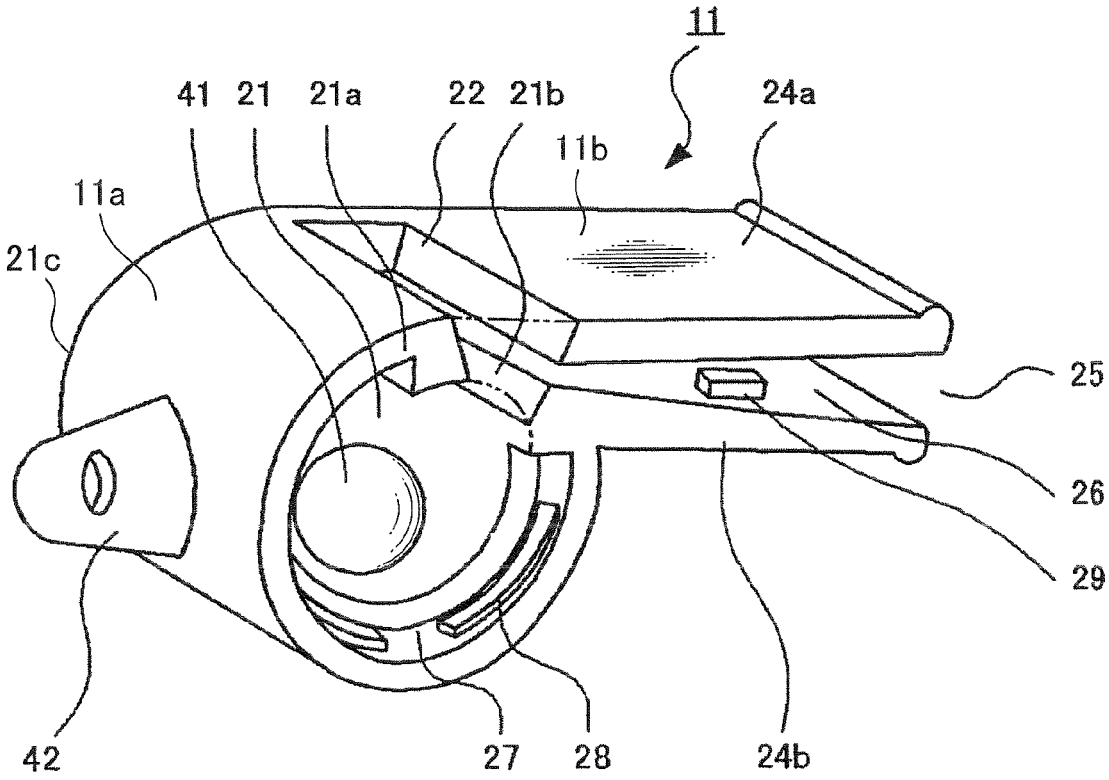
FIG. 2A is a perspective view of the body of the whistle of an embodiment of the invention.
Figure 2B:
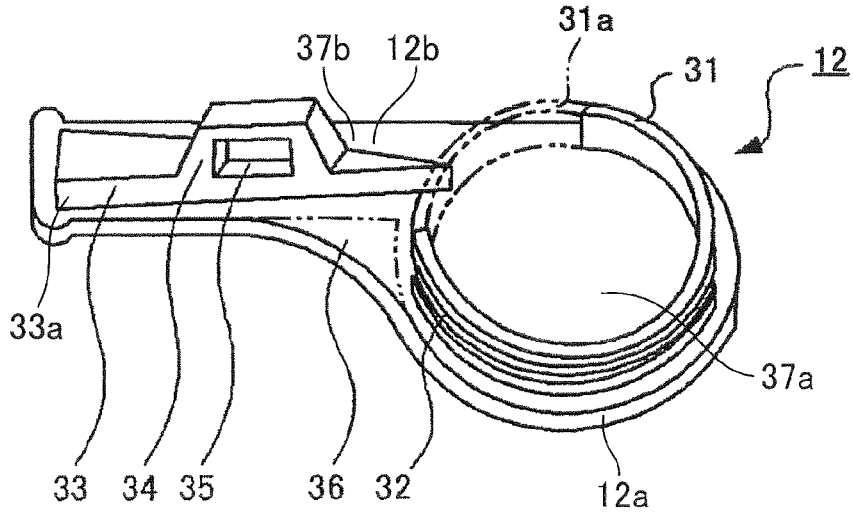
FIG. 2B is a perspective view of the side plate of the whistle of an embodiment of the invention.
Figure 3A:
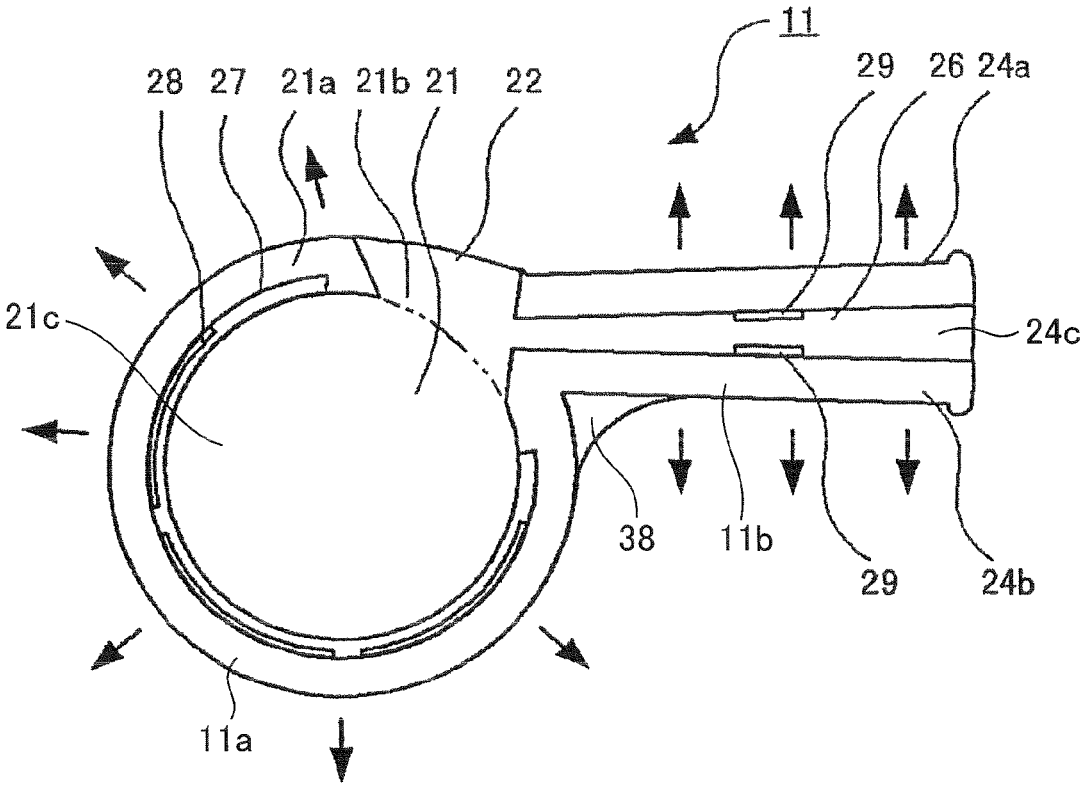
FIG. 3A is a side view of a body, showing the deformed state at the time of attachment and removal, of the whistle of an embodiment of the invention.
Figure 3B:
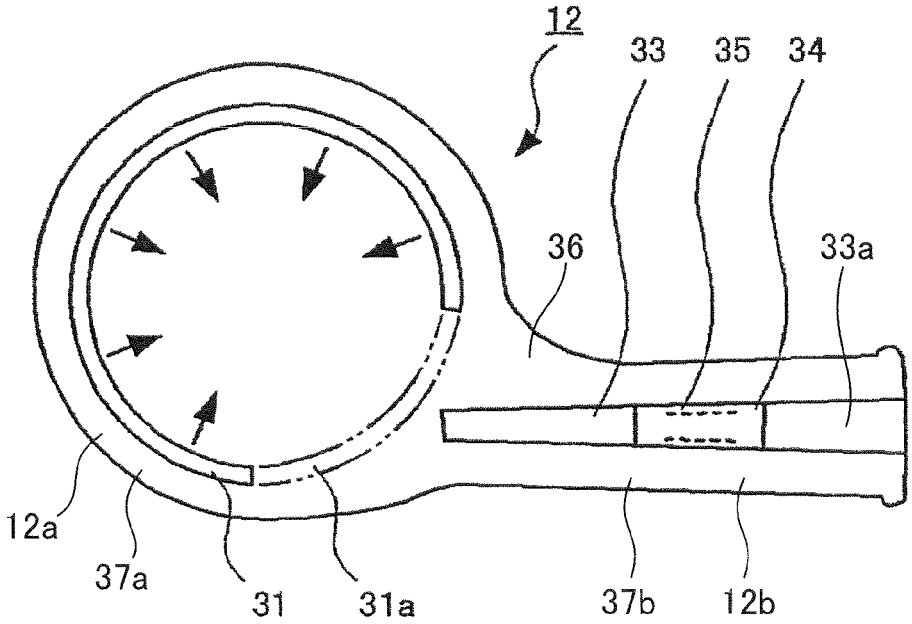
FIG. 3B is a side view of a side plate, showing the deformed state at the time of attachment and removal, of the whistle of an embodiment of the invention.

The disassemblable whistle 1 of an embodiment of the invention is explained, referring to FIG. 1, FIG. 2A, FIG. 2B, FIG. 3A, and FIG. 3B. FIG. 1 shows the external appearance of the whistle 1. FIG. 2A is a perspective view of the body 11, described below. FIG. 2B is a perspective view of the side plate 12, described below. FIG. 3A is a side view of the body 11, and FIG. 3B is a side view of the side plate 12.

As shown in FIG. 1 and FIG. 2A, the whistle 1 has a hollow, substantially cylindrical, cylinder portion 20 extending in the horizontal direction, and a mouthpiece 24 extending in the front-rear direction. A cylindrical resonance chamber 21 is formed inside the cylinder portion 20. An air passageway 26 is formed within the mouthpiece 24. A pea 41, of cork or similar, is accommodated within the resonance chamber 21. A sound-emitting opening 22, which emits sound, is opened in the top face of the portion connecting the cylinder portion 20 and the mouthpiece 24. An air opening 25 into which air is blown is opened at the rear end of the mouthpiece 24. In the whistle 1, exhaled air blown in from the air opening 25 enters the resonance chamber 21 via the air passageway 26, and while causing resonance in the resonance chamber 21, air in the resonance chamber 21 passes through the sound-emitting opening 22 and is emitted.

Grips 43 with disc-shape depressions are provided in both side faces, right and left, of the whistle 1. By grasping these grips 43 with the fingers, the whistle-blower can easily hold the whistle 1. A holder 42 having a penetrating hole is provided on the whistle 1. By passing a string through this penetrating hole, the whistle-blower can suspend the whistle 1 from the neck.

Similarly to general pea-type whistles of the prior art, the outer diameter of the cylinder portion 20 in which the resonance chamber 21 is formed is approximately 19 mm (the thickness of the cylinder wall is 2 mm), and the width of this cylinder portion 20 is approximately 20 mm. The inner diameter of the resonance chamber 21 is approximately 15 mm, and the width on the inside of the resonance chamber 21 is approximately 16 mm.

In a pea-type whistle, a resonance frequency of approximately 4 kHz is optimal, and nearly all whistles of this size adopt this resonance frequency. In order to realize this resonance frequency, from acoustic engineering theory, the diameter of the cylindrical resonance chamber should be approximately 15 mm. If this diameter is greater than 15 mm, the tone is lower, and is unsuitable as a sound evoking caution. And, if this diameter is less than 15 mm, the sound is shrill, the feeling of unpleasantness is increased, and the whistle is inappropriate. The mouthpiece 24 has a length in the front-rear direction of approximately 24 mm, a height of approximately 7 mm, and a width of approximately 16 mm.

The whistle 1 has a body 11, the side face on one end in the left-right direction shown in FIG. 2A of which is open, and a side plate 12, covering the open portion of the body 11 shown in FIG. 2B. By means of a mating mechanism described below, the side plate 12 of this whistle 1 is freely attachable to and removable from the body 11. The body 11 has a resonance chamber portion 11*a*, having a cylindrical shape with a floor, and a mouthpiece portion 11*b*, connected to the rear side of this resonance chamber portion 11*a*. The side plate 12 has a substantially plate-shape first portion 12*a*, and a second portion 12*b* extending from the rear end of the first portion 12*a* in a tangential direction. One side face in the right-left direction of the resonance chamber 11*a* and mouthpiece portion 11*b* of the body 11 is open. The first portion 12*a* of the side plate 12 has a shape which blocks the opening of the resonance chamber 11*a* of the body 11. The second portion 12*b* of the side plate 12 has a shape which blocks the opening of the mouthpiece portion 11*b* of the body 11.

The resonance chamber portion 11*a* of the body 11 has a substantially cylindrical resonance chamber wall 21*a*, the cylinder axis of which extends in the right-left direction, and a floor portion 21*c* covering the face on the side of the resonance chamber wall 21*a* opposite the side plate 12. The side face of the resonance chamber portion 11*a* of the body 11 on the side opposite the floor portion 21*c* is open. A resonance chamber open portion 21*b*, indicated by two-dot dashed lines in FIG. 2A, is formed in the resonance chamber wall 21*a* by cutting a slit shape from the end on the side of the side plate 12 in the direction parallel to the cylinder axis of the resonance chamber wall 21*a*. This resonance chamber wall open portion 21*b* functions as the sound-emitting opening 22 connecting the inside of the resonance chamber 21 and the outside. The length in the front-rear direction of the resonance chamber wall open portion 21*b* is set to approximately 5 mm.

A first flange seat 27, widening in a stair shape in the outward radial direction, is formed on the side of the open end of the resonance chamber portion 11*a* of the body 11, that is, on the inner circumferential face of the end of the resonance chamber wall 21*a* on the side of the side plate 12. The wall thickness of this first flange seat 27 is thinner than other portions of the resonance chamber wall 21*a*, and the inner circumferential face of the first flange seat 27 is positioned radially outside the inner circumferential face of other portions of the resonance chamber wall 21*a*. The width in the cylindrical axis direction of the first flange seat 27 is approximately 5 mm. Three protrusions 28, protruding radially inward, are provided on the inner circumferential face of the first flange seat 27. These protrusions 28 have a width in the cylindrical axis direction of approximately 1.5 mm, a protruding height in the radial direction of approximately 0.3 mm, and a circumferential-direction length of approximately 15 mm. The number of protrusions 28 is not limited to three, and may be two or fewer, or may be four or greater.

It is not absolutely necessary to provide a first flange seat 27 the thickness of which is less than the wall thickness of the side face open end of the resonance chamber wall 21*a*. However, as shown in FIG. 2A, if the wall thickness of the first flange seat 27 is made thin to provide a step at the inner circumferential face of the resonance chamber wall 21*a*, when mounting the side plate 12 on the body 11, the resonance chamber 21 can be made to form a cylindrical shape with no steps. As a result, the occurrence of complex resonances can be avoided, and impedance of motion of the pea 41 can be avoided. Further, air within the resonance chamber 21 does not easily leak to the outside. As a result, lowering of the sound volume during whistle-blowing is avoided.

The mouthpiece portion 11*b* of the body 11 has a mouthpiece upper plate 24*a* extending in the front-rear direction; a mouthpiece lower plate 24*b* positioned below the mouthpiece upper plate 24*a* and extending in the front-rear direction; and a mouthpiece side plate 24*c* connected to one end in the right-left direction of the mouthpiece upper plate 24*a* and the mouthpiece lower plate 24*b* (see FIG. 3A). The side face of the mouthpiece portion 11*b* of the body 11 opposite the mouthpiece side plate 24*c* is open. In this embodiment, the wall thicknesses of the mouthpiece upper plate 24*a* and the mouthpiece lower plate 24*b* are each approximately 2 mm.

On the mouthpiece upper plate 24*a* is provided a protrusion 29 protruding downward from the lower face. And, on the mouthpiece lower plate 24*b* is provided a protrusion 29 protruding upward from the upper face. The protrusion 29 on the mouthpiece upper plate 24*a* and the protrusion 29 on the mouthpiece lower plate 24*b* are mutually opposed. The size of the protrusions 29 is set to, for example, a width of 1.5 mm, a length in the front-rear direction of 5 mm, and a vertical-direction height of approximately 0.3 mm. It is preferable that one or two of these protrusions 29 be formed on both the mouthpiece upper plate 24*a* and the on the mouthpiece lower plate 24*b*.

The first portion 12*a* of the side plate 12 has a plate-shape first base portion 37*a*, and a first flange 31 formed integrally with this first base portion 37*a* and protruding from the first base portion 37*a* on the side of the body 11. The second portion 12*b* of the side plate 12 has a plate-shape second base portion 37*b*, and a second flange 33 formed integrally with this second base portion 37*b* and protruding from the second base portion 37*b* on the side of the body 11. The first base portion 37*a* and second base portion 37*b* are formed integrally, and have overall a flat plate shape.

The first base portion 37*a* of the first portion 12*a* has a shape corresponding to the floor portion 21*c* of the resonance chamber portion 11*a* of the body 11, and has a shape which blocks the opening of the resonance chamber wall 21*a*. By means of the first base portion 37*a*, the floor portion 21*c*, and the resonance chamber wall 21*a*, the resonance chamber 21 is formed. The second base portion 37*b* of the second portion 12*b* has a shape corresponding to the mouthpiece side plate 24*c* of the mouthpiece portion 11*b* of the body 11, and has a shape which blocks the opening of the side face of the mouthpiece portion 11*b* on the side opposite the mouthpiece side plate 24*c*. By means of this second base portion 37*b*, mouthpiece side plate 24*c*, mouthpiece upper plate 24*a*, and mouthpiece lower plate 24*b*, the air passageway 26 is formed.

The first flange 31 mates with the resonance chamber portion 11*a* of the body 11, and more specifically, within the first flange seat 27 in the resonance chamber wall 21*a*. The portion of the first flange 31 corresponding to the sound-emitting opening 22 is cut away as a flange opening portion 31*a*, as indicated by the two-dot dashed lines in FIG. 2B, and has a circular arc shape. The first base portion 37*a* forms the side wall of the sound-emitting opening 22. This flange opening portion 31*a* need not be provided at the position corresponding to the sound-emitting opening 22.

The inner diameter of the first flange 31 is equal to the inner diameter of the resonance chamber 21 (15 mm). This first flange 31, when mated with the inside of the first flange seat 27, forms a portion of the inner wall of the resonance chamber 21. The outside diameter of this first flange 31 is set such that the mating tolerance with respect to the inner diameter of the first flange seat 27 (outer diameter of the first flange 31–inner diameter of first flange seat 27) is −0.1 to +0.3 mm. The tip of this first flange 31 is a rounded face, and can easily be inserted into the first flange seat 27. The first flange 31 has width 5 mm in the cylinder axis direction and a radial-direction wall thickness of 1 mm. Midway in the cylinder axis direction of the first flange 31 is provided, over the entirety of the circumferential direction, a groove-shape latching depression 32, of width 1.6 mm in the cylinder axis direction and depth 0.5 mm.

The second flange 33 mates with the mouthpiece portion 11*b* of the body 11, and more specifically with the mouthpiece upper plate 24*a* and the mouthpiece lower plate 24*b*. It is preferable that the vertical-direction thickness of this second flange 33, relative to the height of the air passageway 26, that is, the distance between the mouthpiece upper plate 24*a* and the mouthpiece lower plate 24*b*, be such that the mating tolerance (thickness of second flange 33–height of air passageway 26) is −0.1 to +0.3 mm.

The second flange 33 has a flange unit 33*a*, and a protruding portion 34 which protrudes from the flange unit 33*a* on the side of the body 11. This protruding portion 34 has a latching depression 35. This depression 35 is formed in a position corresponding to the protrusion 29 on the mouthpiece upper plate 24*a* and the protrusion 29 on the mouthpiece lower plate 24*b*. In the state in which the second flange 33 is mated between the mouthpiece upper plate 24*a* and the mouthpiece lower plate 24*b*, the depression 35 is latched with the protrusion 29. In this embodiment, the depression 35 has a width of 1.6 mm, a length in the front-rear direction of 5.5 mm, and a vertical-direction depth of 0.5 mm. The protrusion 29 and depression 35 are provided in positions so as to be pressed upon by the lips or teeth of the whistle-blower when the whistle-blower holds the mouthpiece 24 in his mouth.

The portion of the second base portion 37*b* of the side plate 12 connected to the first base portion 37*a* protrudes further outward than the body 11 in side view. In FIG. 2B, the body 11 corresponds to the portion indicated by the two-dot dashed line. When the side plate 12 is attached to the body 11, the portion below the two-dot dashed line portion protrudes from the body 11. This protruding portion serves as a tab 36. By placing a finger on this tab 36 and applying force in the lateral direction, the whistle-blower can easily remove the side plate 12.

A tab 38 with shape similar to that of the tab 36 is provided on the opposite side face of the body 11 as well (see FIG. 3A). The whistle 1 has a shape in which, as seen from the side of the air opening 25, right and left side plates protrude downward, like the tires on an automobile. This improves the design of the whistle 1.

These tabs 36 and 38 are curved so as to conform to the lips. Hence when the mouthpiece 24 is held in the mouth, these tabs 36, 38 fit properly against the lower lip. This prevents lateral slipping movement of the whistle 1 and dropping of the whistle 1 from the lips. In this way, the tabs 36 and 38 serve to fix the whistle 1 in place, and are extremely advantageous for applications involving sudden movements, such as in sports refereeing. The tab 38 on the side of the body 11 may be omitted.

The body 11 and side plate 12 are each formed by injection molding, or by other resin molding using dies. As the molding material, a hard resin is used. Due to the conditions of use, it is necessary that a whistle be held in the mouth or clamped with the teeth. Hence a soft resin is inappropriate, and a hard resin with high strength, which resists scratches, shocks, and deformation, must be used. As the hard resin, it is preferable that ABS (Acrylonitrile Butadiene Styrene) be used. In particular, it is desirable that a variety of ABS resin for use in tableware, no component eluents which adverse affect the human body (bisphenol A, formaldehyde, and similar), be used.

Figure 4:
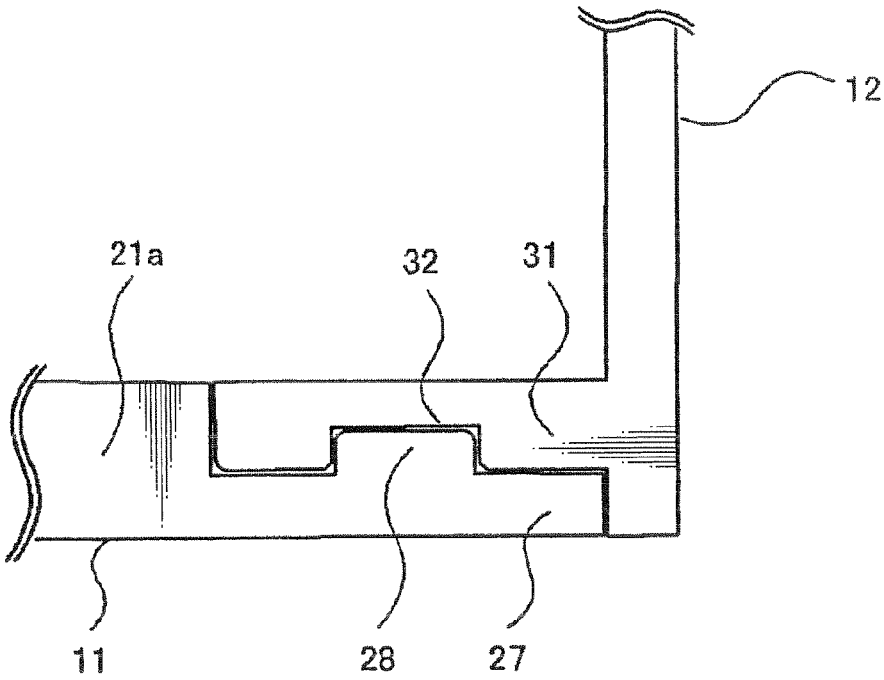
FIG. 4 is a cross-sectional view showing the latched state of the resonance chamber portion in an embodiment of the invention.

Next, attachment and removal of the side plate 12 onto and from the body 11 are explained, referring to FIG. 3A, FIG. 3B, and FIG. 4. FIG. 4 is a cross-sectional view showing the latched state of the protrusions 28 of the first flange seat 27 and the depression 32 of the first flange 31.

First, the mechanism of mating of the side plate 12 and body 11 at the portion of the resonance chamber 21 is explained. When attaching the side plate 12 to the body 11, the side plate 12 is fitted to the open portion of the body 11 on the side of the side plate 12. Then, the side plate 12 is pressed into the body 11. The first flange 31 abuts the protrusions 28 of the first flange seat 27. When the side plate 12 is further pressed into the body 11, the resonance chamber 21 expands radially, as indicated by the arrows in FIG. 3A. Due to the facts that the wall thicknesses of each of the constituent components is thin (1 to 3 mm), and that a resonance chamber wall open portion 21*b* is provided, the resonance chamber wall 21*a* has an elastic deformation function. Hence the resonance chamber wall 21*a*, comprising a hard resin, is elastically deformed and expands radially. The height of the protrusions 28 is minute, at 0.3 mm. Hence when the resonance chamber wall 21*a* is elastically deformed by means of the resonance chamber wall opening portion 21*b*, through retraction of the protrusions 28, the first flange 31 advances as-is to the inside of the first flange seat 27. And, as shown in FIG. 4, the protrusions 28 of the first flange seat 27 and the depression 32 of the first flange 31 are engaged.

If the cutout of the resonance chamber wall open portion 21*b* in the resonance chamber wall 21*a* were absent, and the wall was formed as a completely closed annulus, then even when an attempt was made to pressure-fit the first flange 31 with substantially the same dimensions as the first flange seat 27, the first flange 31 would catch on the protrusions 28 of the first flange seat 27. In the case of a closed annulus comprising a hard resin, the resonance chamber would not expand radially. Hence the first flange 31 would remain abutting the protrusions 28 and would not advance further into the body 11. Consequently, it would not be possible to attach the first flange 31, and therefore the side plate 12, to the body 11. The hard resin itself has no flexibility. Hence if the first flange 31 were forcibly press-fitted into the first flange seat 27, the protrusions 28 would be damaged, and the side plate 12 could not be latched to the body 11.

As explained above, in the whistle 1 of this embodiment a cutout, that is, the resonance chamber wall open portion 21*b*, is cleverly utilized to enable elastic deformation of the body 11 even when formed using a hard resin, to enable attachment and removal of the side plate 12.

A cutout, that is, a flange open portion 31*a*, is also formed in the first flange 31. Due to the fact that a flange open portion 31*a* is provided, the first flange 31 itself has an elastic deformation function. When the first flange 31 abuts the protrusions 28 of the first flange seat 27, elastic deformation occurs and there is contraction inward, as indicated by the arrows in FIG. 3B. By this means, the first flange 31 is easily press-fitted into the first flange seat 27.

If, during attachment and removal, the tip portion of the first flange 31 and the protrusions 28 of the first flange seat 27 are angled, press-fitting of the first flange 31 is impeded. Hence as shown in FIG. 4, the angular portions of the tip portion of the first flange 31 and of the protrusions 28 of the first flange seat 27 may be chamfered.

Here, the above-described mating tolerance is described in detail. When the mating tolerance for the outer shape of the first flange 31 with respect to the inner diameter of the first flange seat 27 is set to −0.1 to 0.0 mm, the first flange 31 is latched to the body 11 merely by latching the depression 32 and the protrusion 28. In this case, there exists no restoring force in the resonance chamber wall 21*a* or in the first flange 31. However, the whistle 1 is lightweight (8 to 12 g), and is formed from a hard resin. Hence in a normal state of use, or upon a shock when dropped or in other instances, a force sufficient to release the engagement of the depression 32 and protrusions 28 does not occur, and there are no practical problems.

On the other hand, when the mating tolerance is set to 0.0 to 0.3 mm, in addition to engaging the depression 32 and the protrusions 28, the restoring force in the resonance chamber wall 21*a* or in the first flange 31 latches the first flange 31 to the body 11. That is, the contact faces of the first flange 31 and first flange seat 27 are pressed together, and the first flange 31 is latched to the body 11 by means of this pressing force. This heightens the close adhesion between the side plate 12 and the body 11, so that firm engagement of the side plate 12 to the body 11 and a high degree of airtightness are achieved.

When the mating tolerance is −0.1 or lower, the gap between the first flange 31 and the first flange seat 27 is too large, and the first flange 31 easily separates from the body 11. And, when the mating tolerance is 0.3 mm or greater, a strong force is required when attaching or removing the side plate 12, so that easy attachment and removal of the side plate 12 is difficult.

Next, the mechanism of mating of the mouthpiece 24 portion of the side plate 12 with the body 11 is explained. The side plate 12 is fitted with the open portion of the body 11. When the side plate 12 is pressed into the body 11, the second flange 33 advances into the open portion of the air passageway 26, and the protrusion 29 on the mouthpiece upper plate 24*a* and the protrusion 29 on the mouthpiece lower plate 24*b* each mate with the depression 35 in the second flange 33, so that the second flange 33 is latched to the body 11.

The mouthpiece 24 portion of the body 11 has a long narrow U shape, with three sides open. When a member somewhat larger (from 0.1 to 1.0 mm) than the open portion intrudes into this open portion, the mouthpieces 24 portion of the body 11 is elastically deformed, as indicated by the arrows in FIG. 3A. Specifically, the mouthpiece upper plate 24*a* is displaced upward, the mouthpiece lower plate 24*b* is displayed downward. The heights of the protrusion 29 on the mouthpiece upper plate 24*a* and of the protrusion 29 on the mouthpiece lower plate 24*b* are minute, at 0.3 mm. Hence even if the second flange 33 collides with the protrusions 29, as a result of retraction of these protrusions 29, the second flange 33 is press-fit until these protrusions 29 enter into the depression 35. In this way, the mouthpiece 24 portion of the body 11 has a shape, appropriate for a spring, such that one side face in the left-right direction is open, and acts as a spring which is optimal for a mating mechanism. The above-described ABS resins are themselves excellent spring materials, and together with excellent strength, inflammability, and health safety, is an optimal material for the whistle of this embodiment.

With respect to the mating tolerance between the second flange 33 and the mouthpiece 24 portion of the body 11, remarks similar to those above for the resonance chamber wall 21*a* and first flange 31 can be made. That is, when the mating tolerance is −0.1 to 0.0 mm, the second flange 33 is latched to the body 11 merely by the engagement force of the depression 35 of the second flange 33 and the protrusions 29 of the body 11. When the tolerance is 0.0 to 0.3 mm, the second flange 33 is latched to the body 11 by the restoring force of the mouthpiece 24 portion of the body 11, in addition to engaging of the depression 35 of the second flange 33 and the protrusions 29 of the body 11. In the former case also, there is for practical purposes a sufficient force to prevent separation of the side plate 12. And in the latter case, as a result of pressing together and engaging of the large mating force of the mouthpiece 24 portion of the body 11 and the second flange 33, a larger force preventing separation of the side plate 12, and greater airtightness between the side plate 12 and the body 11, are attained.

The protrusion 29 on the mouthpiece upper plate 24*a*, the protrusion 29 on the mouthpiece lower plate 24*b*, and the depression 35 in the second flange 33 are provided at places which are pressed vertically by the lips or teeth when the whistle-blower holds the mouthpiece 24 in the mouth. The force with which the lips or teeth hold the mouthpiece 24 strengthens the latching of the protrusions 29 with the depression 35. This means that during use of the whistle 1, separation of the side plate 12 is prevented. The depression 35 is provided in the protruding portion 34 of the second flange 33. Hence even if the whistle-blower bits powerfully on the mouthpiece 24 during use, the protruding portion 34 supports the mouthpiece upper plate 24*a* and mouthpiece lower plate 24*b*. This prevents crushing of the mouthpiece 24.

In order to remove the side plate 12 to perform cleaning or for other reasons, a finger is placed on the tab 36, and the tab 36 is pulled in the direction opposite the body 11. The tab 36 protrudes from 3 to 5 mm from the body 11, so that the user can easily place a finger on this tab 36. As explained above, the resonance chamber wall open portion 21*b* of the resonance chamber wall 21*a* is open. Hence when the side plate 12 is pulled in the direction opposite the body 11, the resonance chamber wall 21*a* expands radially. And, the first flange 31 is compressed inward and is elastically deformed. As a result, the engagement state of the protrusions 28 of the first flange seat 27 and the depression 32 of the first flange 31 is easily released.

Further, the mouthpiece upper plate 24*a* is displaced upward, and the mouthpiece lower plate 24*b* is displaced downward. As a result, the engagement state of the protrusion 29 on the mouthpiece upper plate 24*a*, the protrusion 29 on the mouthpiece lower plate 24*b*, and the depression 35 of the second flange 33 is released, and the side plate 12 is removed from the body 11.

In this way, according to the whistle 1 of this embodiment, the side plate 12 can easily be removed, completely exposing the interior of the whistle 1. Hence the interior of the whistle 1 can easily be cleaned, and saliva and similar remaining in the interior can be completely removed. Moreover, a pea of porous material, in which bacteria easily breed, can be removed, and the pea can be cleaned to ensure good hygiene. Hence hygiene of the whistle 1 can be secured, without breeding of bacteria in the interior of the whistle 1. And, the whistle 1 does not give off offensive smells, and any feeling of unpleasantness of the user is eliminated. Moreover, a feeling of unpleasantness resulting when others use it is also alleviated.

Upon being blown, the freely disassemblable whistle 1 of this embodiment is not inferior to a whistle of the prior art bonded by ultrasonic bonding or with an adhesive. This is because nearly all the air flowing in from the air opening flows to the sound-emitting opening 22, without passing through a gap in the mating portion of the side plate 12 and body 11, which compared with the sound-emitting opening 22 is minute at 0.05 to 0.1 mm, and which moreover has a bent path and offers greater air resistance.

The inner diameter of the first flange 31 is the same as the diameter of the resonance chamber wall 21*a*. The volume of the resonance chamber 21 is similar to that of a conventional whistle which cannot be disassembled. Hence the whistle-blowing sound is also not inferior to that of a whistle of the prior art. The protruding portion 34 blocks the air passageway 26, but only a portion, rather than the entire length, of the air passageway 26 is blocked, and the whistle can be used similarly to whistles of the prior art, with no difficulty of blowing.

In the above explanation, protrusions 28, 29 for latching were provided on the body 11, and depressions 32, 35 were provided in the side plate 12; but clearly the opposite configuration may be used. That is, protrusions 28, 29 may be provided on the side plate 12, with depressions 32, 35 provided on the body 11. Also, the shapes and sizes of the depressions and protrusions used for mating can of course be modified in various ways. For example, the cross-sectional shapes may be circular, or may be V-shaped.

Further, in the above explanation an example of a pea-type whistle was given; but the invention is not limited to such whistles, and application to a pealess-type whistle is also possible. As explained above, a major characteristic of attachment and removal by means of the mating mechanism of the whistle 1 of this embodiment is the presence of a cutout in a portion of the body 11 or side plate 12. So long as a cutout exists, the hard resin material can undergo elastic deformation, and so the mechanism of mating of the body and side plate or other mated plate functions effectively.

Figure 5:
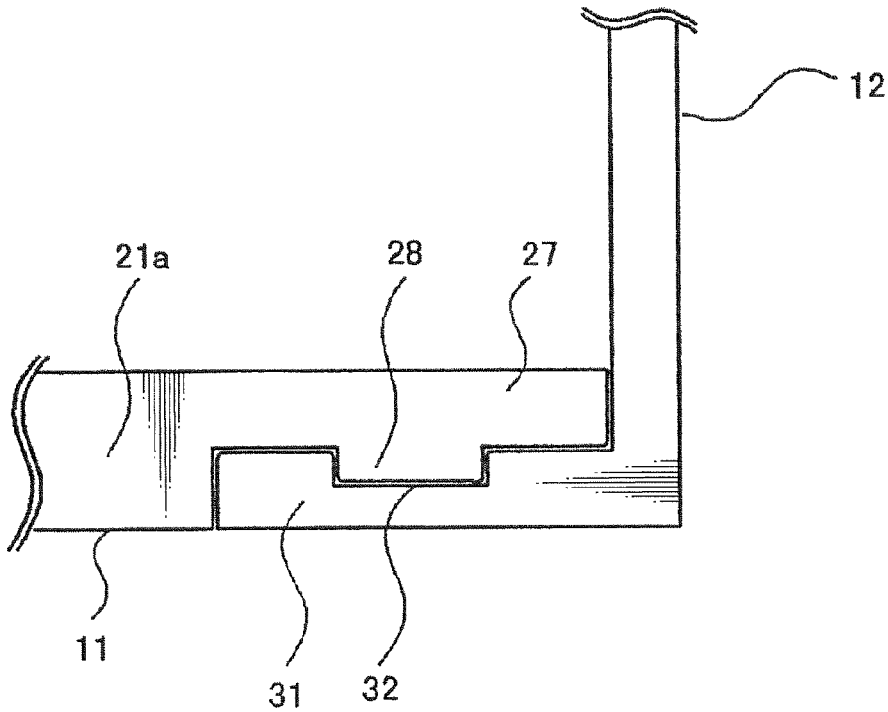
FIG. 5 is a cross-sectional view showing the latched state of the resonance chamber portion of the whistle in another embodiment of the invention.

FIG. 5 is a cross-sectional view showing the latched state of the resonance chamber portion in the whistle of another embodiment. In a structure opposite that described above, the first flange 31 of the side plate 12 forms the whistle outer shape, and the flange seat 27 of the body 11 is mated with the inside of the first flange 31. Otherwise the structure is similar to that described above.

Here, the "flange" is the portion providing from the side face of the side plate 12, and the place in the open end of the body 11 corresponding to this flange is the flange seat.

When attaching the side plate 12 to the body 11, the tip of the first flange 31 abuts the protrusion 28 provided on the flange seat 27. At this time, due to the resonance chamber wall open portion (not shown), the resonance chamber wall 21*a* is elastically deformed, and the resonance chamber wall 21*a* contracts. On the other hand, the first flange 31 is elastically deformed due to the flange open portion (not shown), and expands radially. By this means, the first flange 31 advances to outside the first flange seat 27. Other respects are similar to those described above, and an explanation is omitted.

In this way, even when the first flange 31 envelops the flange seat 27, by means of the resonance chamber wall open portion or the flange open portion, the resonance chamber wall 21*a* and first flange 31 are elastically deformed, and the side plate 12 can easily be attached to and removed from the body 11. Further, on the side of the mouthpiece as well, the second flange may be formed on the side plate in the external shape of the mouthpiece, in a configuration which envelops the mouthpiece upper plate and mouthpiece lower plate.

Embodiments

Investigations were performed to confirm that there was no decline in sound volume or change in sound quality. A whistle of this embodiment, as well as a whistle of the same shape and dimensions with the side plate completely bonded as a reference example, that is, a whistle with no attachment or removal mechanism (hereafter the "reference example"), were prepared. As the whistle of the embodiment, a whistle which had been subjected to 1000 cycles of side plate attachment and removal was used. Through this attachment and removal, the durability of the mating portions was confirmed. When attachment/removal and cleaning are performed daily, 1000 cycles is equivalent to use over approximately three years.

Air compressed by a compressor was supplied via a regulator (constant-pressure device) to the air openings of each of the whistles in an anechoic chamber. The whistle-blowing sound generated by the whistles was measured using a sound-level meter installed at 1 m from the whistles, and differences in sound volume were examined.

The results were 101 dB for the whistle of this embodiment, and on the other hand 103 dB for the reference example. The difference is 2 dB, which in places with a large amount of surrounding noise, is indistinguishable to the human ear. It was shown that in the whistle of this embodiment, even when the side plate can be freely attached and removed, the air flowing in from the air opening is expelled from the sound-emitting opening with almost no leakage. In particular, even a whistle which has undergone 1000 cycles of side plate attachment and removal was confirmed to show no decline in performance. Thus no effective decline in sound volume was observed, and it was confirmed that there is no impairment of the whistle function, which is to cause listeners to recognize the whistle sound.

Further, the sound-level meter output obtained in the above experiments was input to a spectrum analyzer and analyzed, and frequency characteristics were examined.

Figure 6A:
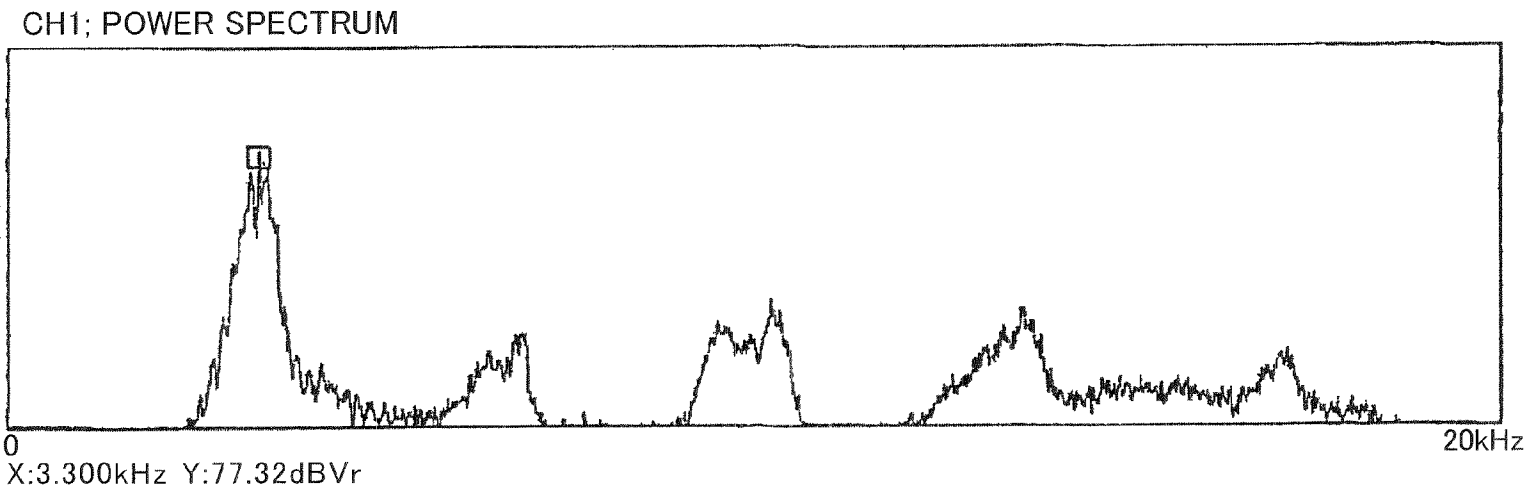
FIG. 6A is the power spectrum of the frequency components of the whistle in an embodiment of the invention.
Figure 6B:
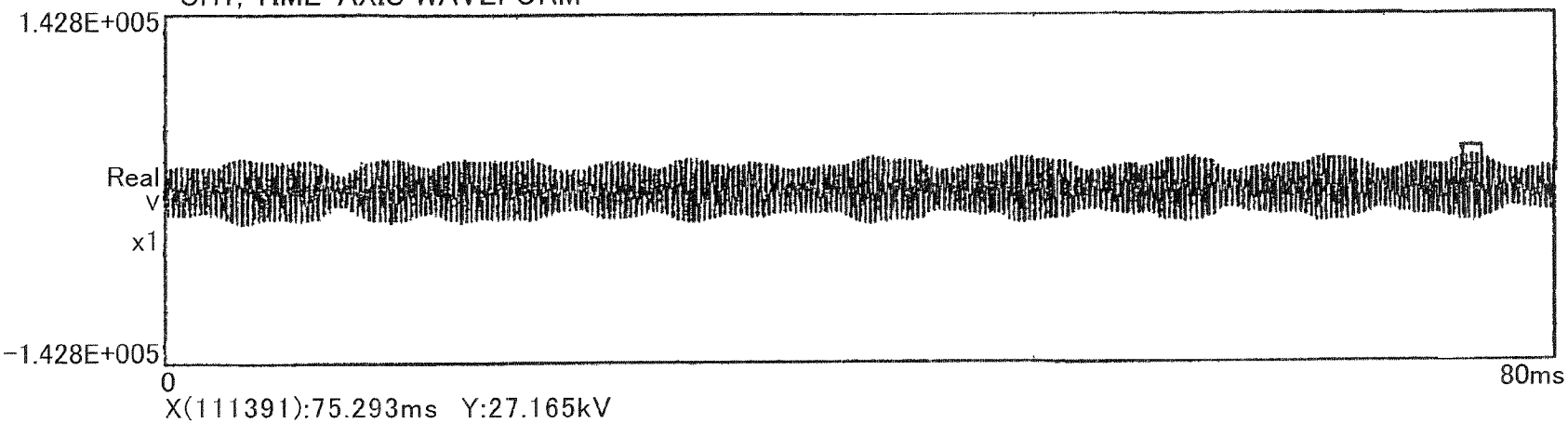
FIG. 6B shows the measured time-axis waveform for the whistle of an embodiment of the invention.
Figure 7A:
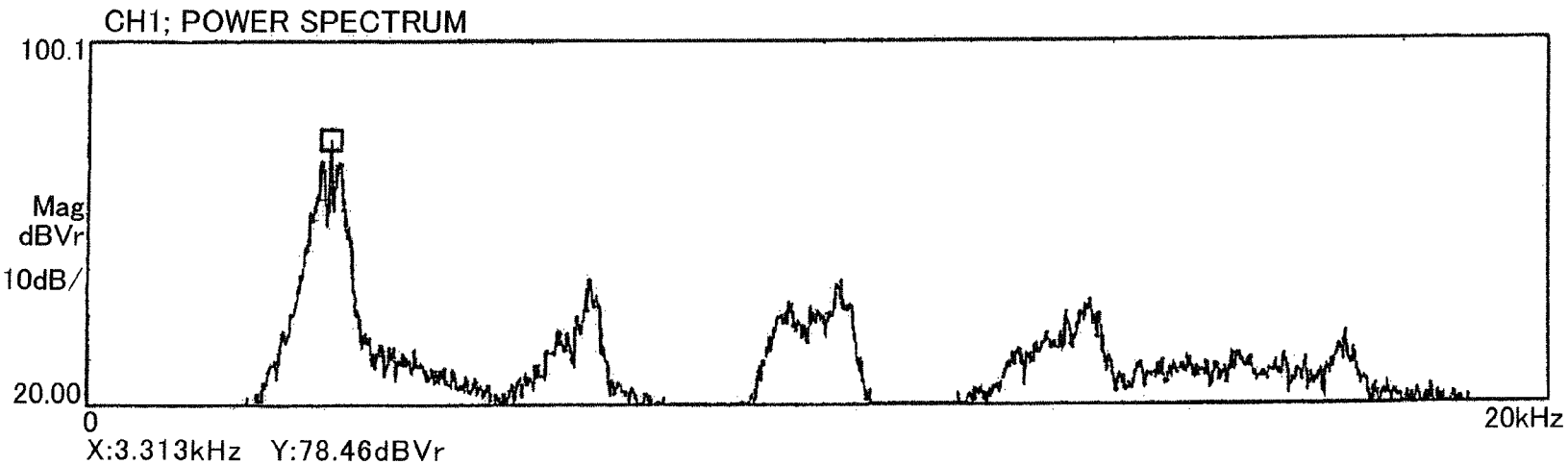
FIG. 7A PRIOR ART
FIG. 7A is the power spectrum of the frequency components of a whistle not having an attachment/removal mechanism.
Figure 7B:
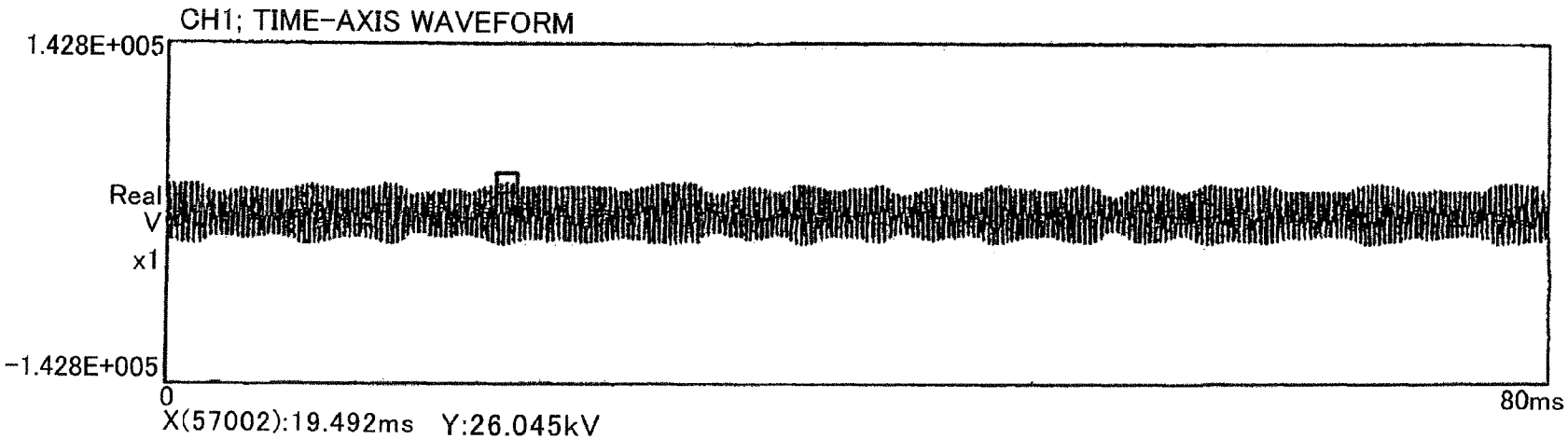
FIG. 7B PRIOR ART
FIG. 7B shows the measured time-axis waveform for a whistle not having an attachment/removal mechanism.
Figure 8:
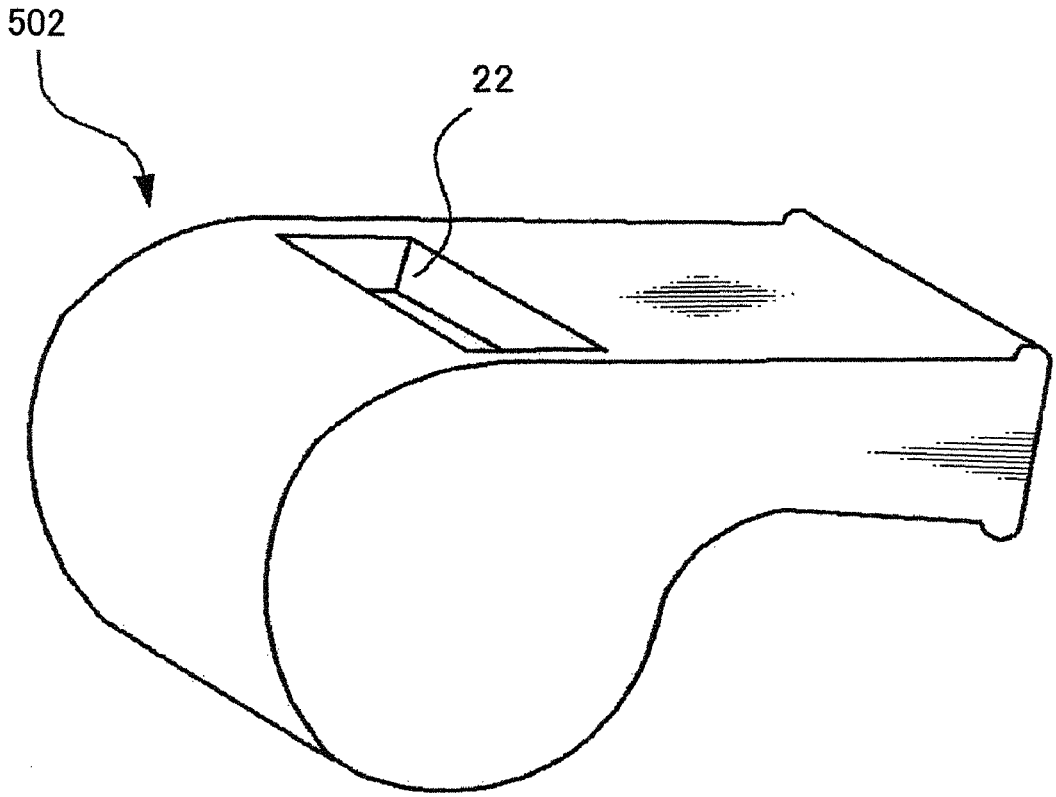
FIG. 8 PRIOR ART
FIG. 8 is a perspective view showing the external appearance of a whistle of the prior art.

The results appear in FIG. 6A and FIG. 6B and in FIG. 7A and FIG. 7B. FIG. 6A and FIG. 6B are measurement results for the whistle of this embodiment; FIG. 6A is the frequency component power spectrum, and FIG. 6B is the time-axis waveform. FIG. 7A and FIG. 7B are measurement results for the reference example; FIG. 7A is the frequency component power spectrum, and FIG. 7B is the time-axis waveform.

As is understood from FIG. 6 and FIG. 7, no difference is seen in the frequency components and time-axis waveforms of the whistle of this embodiment and the whistle of the reference example. This indicates that there is no difference in the acoustics of the two, and that sound quality is not worsened even when a configuration enabling attachment and removal of the side plate is employed, as in this embodiment.

Next, drop impact tests of the whistle of this embodiment were performed. The whistle was dropped from a height of 1.7 m onto a concrete surface. Drops were performed 20 times each in the X, Y, and Z directions of the whistle, for a total of 60 drops, and not once was there separation of the side plate.

Further, throwing impact tests were performed. The whistle was thrown hard 20 times against a wooden wall separated by 1 m. As a result, not once was there separation of the side plate, and durability against shocks was confirmed.

From the above, the whistle of this embodiment can be blown without impairment of the sound volume or sound quality required of a whistle. Moreover, the side plate can easily be attached and removed, and the interior can be cleaned completely, so that hygiene can always be secured. Further, the whistle of this embodiment has excellent durability, with no impairment of functions even after repeated use, and separation of the side plate does not occur even under impact.

As explained above, in this embodiment a whistle is provided comprising a body, having a resonance chamber wall with one face of a resonance chamber formed by the resonance chamber wall open, and a side plate which is formed separately from the body and can be attached to and removed from the body; the side plate has a first portion which blocks the one face of the resonance chamber in the state of being attached to the body, and a first flange which is provided on the first portion and engageable with the resonance chamber wall; at least one of the resonance chamber wall and the first flange is elastically deformable; and an air passageway, the resonance chamber, an air opening which is opened in the air passageway, and a sound-emitting opening which is opened in the resonance chamber, are formed by means of the body and the side plate.

By means of this whistle, by elastically deforming the resonance chamber wall or the first flange to cause expansion or contraction, the side plate can easily be attached to and removed from the body. As a result, the resonance chamber, air passageway, and other interior areas of the whistle can be cleaned more reliably, breeding of bacteria due to remaining saliva can be suppressed, and whistle hygiene can be preserved.

It is preferable that a portion of the resonance chamber wall be cut out to enable elastic deformation in the direction to expand or contract the resonance chamber. By means of this configuration, the resonance chamber wall can easily be expanded or contracted and separation of the side plate from the body due to the restoring force of the resonance chamber wall can be suppressed.

It is preferable that a portion of the first flange be cut out to enable elastic deformation in the direction to expand or contract the resonance chamber. By means of this configuration, the first flange can easily be expanded or contracted and separation of the side plate from the body due to the restoring force of the first flange wall can be suppressed.

It is preferable that the resonance chamber wall have a protrusion or a depression, and that the first flange have a depression or a protrusion which is engageable with the protrusion or depression of the resonance chamber wall, and which moreover causes the first flange to be latched to the resonance chamber wall. By this means, through latching of the protrusion and depression, separation of the side plate from the body can be more reliably suppressed.

It is preferable that the resonance chamber wall have a flange seat, thinner than other portions of the resonance chamber wall, at the end portion on the side of the one face of the resonance chamber, and that the protrusion or depression of the resonance chamber wall be provided at the flange seat portion. By this means, separation of the side plate can be suppressed through engagement of the depression and protrusion, while suppressing the occurrence of a step in the inner wall face of the resonance chamber, and suppressing leakage of air from the resonance chamber.

It is preferable that the body have a mouthpiece upper plate and mouthpiece lower plate; that the side plate have a second portion and a second flange provided on the second portion, and which is engageable with the mouthpiece upper plate and mouthpiece lower plate; that the air passageway is formed by the mouthpiece upper plate, the mouthpiece lower plate, and the side plate, and that the mouthpiece upper plate and mouthpiece lower plate are elastically deformable in a direction to cause expansion or contraction of the air passageway.

By this means, by elastically deforming the mouthpiece upper plate and mouthpiece lower plate and the second flange, the side plate can easily be attached to and removed from the body, while suppressing separation of the side plate from the body.

It is preferable that the mouthpiece upper plate and the mouthpiece lower plate have a protrusion or a depression, and that the second flange have depressions or protrusions which are engageable with the protrusions or depressions of the mouthpiece upper plate and mouthpiece lower plate, and which cause the second flange to be latched to the mouthpiece upper plate and the mouthpiece lower plate. By this means, through latching of the protrusions and depressions, separation of the side plate from the body can be more reliably suppressed.

It is preferable that the protrusions or depressions of the mouthpiece upper plate and mouthpiece lower plate be positioned at locations which are pressed upon by the lips or teeth of a whistle-blower. By this means, the force engaging the protrusions and depressions is heightened by the lips or teeth of a whistle-blower, and separation of the side plate from the body can be further suppressed.

It is preferable that the second flange have a protruding portion, and that the protrusion or depression of the second flange be provided on the protruding portion.

It is preferable that the side plate have a tab which protrudes from the mouthpiece upper plate or from the mouthpiece lower plate. By means of this configuration, the tab can be used to easily remove the side plate from the body.

This application is based on Japanese patent application No. 2008-119973 filed in Japan Patent Office on May 1, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A whistle, comprising:

a body, having a resonance chamber wall and a resonance chamber formed by the resonance chamber wall, the resonance chamber having one open face, the resonance chamber wall being formed with a protrusion or a depression; and a side plate formed separately from the body, and can be attached to and removed from the body, the side plate having a first portion that blocks the one face of the resonance chamber when the side plate is attached to the body, and a first flange provided on the first portion, the first flange having a depression or a protrusion that is engageable with the protrusion or depression of the resonance chamber wall and that causes a latching of the first flange to the resonance chamber wall, wherein at least one of the resonance chamber wall and the first flange is elastically deformable, an air passageway, the resonance chamber, an air opening which is opened in the air passageway, and a sound-emitting opening which is opened in the resonance chamber, are formed by means of the body and the side plate, and the resonance chamber wall has, at an end portion on the side of the one face of the resonance chamber, a flange seat portion thinner than other portions of the resonance chamber wall, and the protrusion or depression of the resonance chamber wall is provided on the flange seat portion.

2. The whistle according to claim 1, wherein the resonance chamber wall is elastically deformable by cutting out a portion thereof in a direction to accommodate expansion or contraction of the resonance chamber.

3. The whistle according to claim 1, wherein the first flange is elastically deformable by cutting out a portion thereof in a direction to accommodate expansion or contraction of the resonance chamber.

4. A whistle, comprising:

a body having a resonance chamber wall and a resonance chamber formed by the resonance chamber wall, the resonance chamber having an open face and a sound-emitting opening, the body further having a mouthpiece upper plate and a mouthpiece lower plate extending from the resonance chamber wall and forming an air passageway therebetween, the air passageway communicating with the resonance chamber, an air opening being open into the air passageway, the mouthpiece upper plate and the mouthpiece lower plate being elastically deformable in a direction to accommodate expansion or contraction of the air passageway; and a side plate formed separately from the body, and being attachable to and removable from the body, the side plate having a first portion that blocks the open face of the resonance chamber when the side plate is attached to the body while leaving the sound emitting opening open, a first flange provided on the first portion and being engageable with the resonance chamber wall, at least one of the resonance chamber wall and the first flange being elastically deformable, the side plate further having a second portion and a second flange provided on the second portion, the second flange being engageable with the mouthpiece upper plate and with the mouthpiece lower plate so that the second portion of the side plate blocks an open side of the air passageway when the side plate is attached to the body while leaving the air opening open.

5. The whistle according to claim 1, wherein the body has a mouthpiece upper plate and a mouthpiece lower plate, the side plate has a second portion and a second flange which is provided on the second portion and is engageable with the mouthpiece upper plate and with the mouthpiece lower plate, the air passageway is formed by the mouthpiece upper plate, the mouthpiece lower plate, and the side plate, and the mouthpiece upper plate and the mouthpiece lower plate are elastically deformable in a direction to accommodate expansion or contraction of the air passageway.

6. The whistle according to claim 5, wherein the mouthpiece upper plate and the mouthpiece lower plate have a protrusion or a depression, and the second flange has depressions or protrusions which are engageable with the protrusions or depressions of the mouthpiece upper plate and the mouthpiece lower plate, and which cause latching of the second flange to the mouthpiece upper plate and to the mouthpiece lower plate.

7. The whistle according to claim 6, wherein the protrusions or depressions of the mouthpiece upper plate and the mouthpiece lower plate are positioned at locations which are pressed upon by the lips or teeth of a whistle-blower.

8. The whistle according to claim 6, wherein the second flange has a protruding portion, and the protrusion or depression of the second flange is provided on the protruding portion.

9. The whistle according to claim 5, wherein the side plate has a tab which protrudes from the mouthpiece upper plate or from the mouthpiece lower plate.

10. The whistle according to claim 4, wherein the resonance chamber wall has a protrusion or a depression, and the first flange has a depression or a protrusion which is engageable with the protrusion or depression of the resonance chamber wall, and which causes latching of the first flange to the resonance chamber wall.

11. The whistle according to claim 4, wherein the mouthpiece upper plate and the mouthpiece lower plate have a protrusion or a depression, and the second flange has depressions or protrusions that are engageable with the protrusions or depressions of the mouthpiece upper plate and the mouthpiece lower plate, and which cause latching of the second flange to the mouthpiece upper plate and to the mouthpiece lower plate.

12. The whistle according to claim 11, wherein the protrusions or depressions of the mouthpiece upper plate and the mouthpiece lower plate are positioned at locations that are pressed upon by the lips or teeth of a whistle-blower.

13. The whistle according to claim 11, wherein the second flange has a protruding portion, and the protrusion or depression of the second flange is provided on the protruding portion.

14. The whistle according to claim 4, wherein the side plate has a tab that protrudes from the mouthpiece upper plate or from the mouthpiece lower plate.

* * * * *